US005861044A

United States Patent [19]

Crenshaw

[11] Patent Number: 5,861,044

[45] **Date of Patent: *Jan. 19, 1999**

[54] METHOD TO SELECTIVELY CARVE TEXTILE FABRICS

[75] Inventor: Edward Leland Crenshaw, Inman, S.C.

[73] Assignee: Milliken Research Corporation, Spartanburg, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 760,779

[22] Filed: Dec. 5, 1996

Related U.S. Application Data

[63] Continuation of Ser. No. 617,526, Mar. 15, 1996, abandoned, which is a continuation of Ser. No. 405,150, Mar. 16, 1995, abandoned.

[51] Int. Cl.[6] ..... D06Q 1/00

[52] U.S. Cl. ..... 8/115; 8/114; 8/114.6; 8/148; 8/149.2; 8/149.1; 8/158; 8/159; 8/481; 8/485; 8/486; 8/487; 8/483; 8/478

[58] Field of Search ..... 8/114, 114.6, 115, 8/148, 149.2, 149.1, 158, 159, 481, 485, 486, 487, 483, 478

[56] References Cited

U.S. PATENT DOCUMENTS

| | | | |
|---|---|---|---|
| 4,215,991 | 8/1980 | Steiger | 8/115 |
| 4,290,766 | 9/1981 | Burns, Jr. et al. | 8/491 |
| 4,364,156 | 12/1982 | Greenway et al. . | |
| 4,589,884 | 5/1986 | Gilpatrick | 8/481 |

FOREIGN PATENT DOCUMENTS

| | | |
|---|---|---|
| 1 460 608 | 3/1969 | Germany . |
| 1-213470 | 8/1989 | Japan . |
| 761075 | 11/1956 | United Kingdom . |

*Primary Examiner*—Alan Diamond

*Attorney, Agent, or Firm*—Terry T. Moyer; George M. Fisher

[57] ABSTRACT

An apparatus and method for selectively carving textile fabric by selectively applying chemicals containing a liquid repellent either alone or with other chemicals such as dye to a textile fabric and subsequently finishing said fabric. The textile fabric is then rewetted by the application of liquid. The printed areas containing liquid repellant remain dry and the areas without liquid repellent are selectively wetted out. The textile fabric is then subjected to pressurized heated gas which selectively carves the dry areas printed with liquid repellent leaving the wetted areas protected and uncarved. As an alternative embodiment, the yarns that make up a textile fabric can be individually treated with a liquid repellent prior to being formed into a textile fabric.

11 Claims, 6 Drawing Sheets

METHOD TO SELECTIVELY CARVE TEXTILE FABRICS

This application is a continuation of application Ser. No. 08/617,526, filed Mar. 15, 1996 now abandoned, which is a continuation-in-part of application Ser. No. 08/405,150, filed Mar. 16, 1995 now abandoned.

BACKGROUND OF THE INVENTION

Traditional methods of selectively carving patterns in textile fabrics have developed numerous problems. A significant problem is the ability to precisely carve a very exact pattern or carve in exact registration with a pattern printed in color. In addition, non-precise carving can weaken and even destroy the textile fabric.

The present invention solves these problems in a manner not disclosed by the known prior art.

SUMMARY OF THE INVENTION

An apparatus and method for selectively carving textile fabric by selectively applying chemicals containing a liquid repellent either alone or with a chemical such as dye to a textile fabric and subsequently finishing said fabric. The textile fabric is then rewetted by the application of liquid. The printed areas containing liquid repellant remain dry and the areas without liquid repellent are selectively wetted out. The textile fabric is then subjected to pressurized heated gas which selectively carves the dry areas printed with liquid repellent leaving the wetted areas protected and uncarved. As an alternative embodiment, the yarns that make up a textile fabric can be individually treated with a liquid repellent prior to being formed into a textile fabric.

It is an advantage of this invention that the carved patterns can be as precise as any available patterning process.

It is another advantage of this invention that the means of carving the textile fabric is very exact so that the textile fabric remains relatively intact.

Yet another advantage of this invention is that the carved patterns can be in exact registration with a printed pattern.

Still another advantage of this invention is that carving can be extremely complex with the only limits being those of the patterning process utilized.

These and other advantages will be in part apparent and in part pointed out below.

BRIEF DESCRIPTION OF THE DRAWINGS

The above, as well as other objects of the invention, will become more apparent from the following detailed description of the preferred embodiments of the invention when taken together with the accompanying drawings in which.

DETAILED DESCRIPTION OF THE PREFERRED EMBODIMENT

Figures 1, 2:
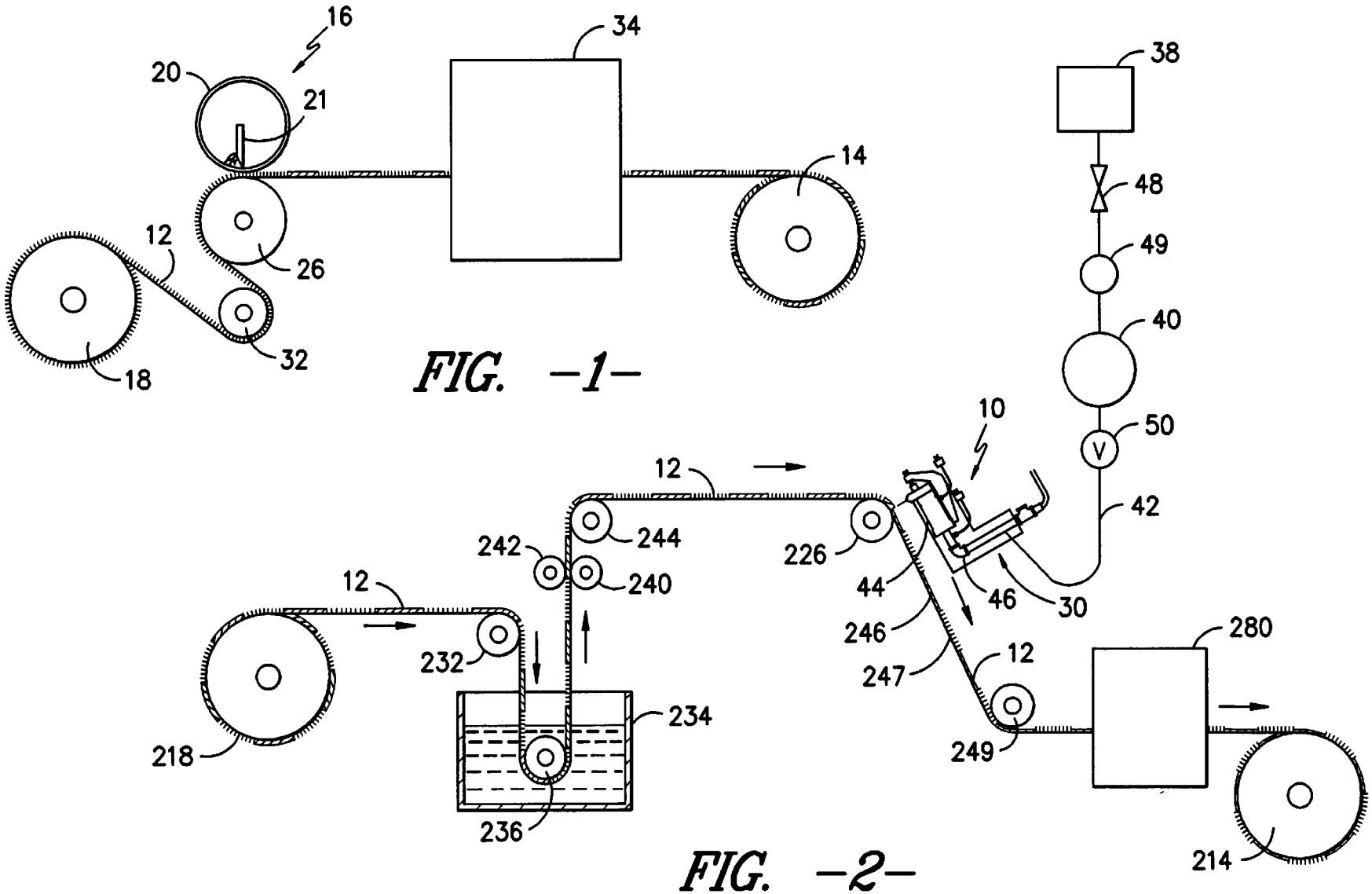
FIG. 1 is the schematic side elevation view of an apparatus for selectively applying chemicals containing liquid repellent either alone or with a colorant such as a dye to a moving textile fabric in a pattern arrangement.
FIG. 2 is a schematic side elevation view of an apparatus for rewetting the textile fabric and carving the textile fabric that has been treated with a liquid repellent, as was previously disclosed in FIG. 1.

Referring now to the accompanying drawings, initially to FIG. 1, an indefinite length of textile fabric 12, from a supply roll 18 passes over an idler roll 32 and into a dyeing apparatus 16. The dyeing apparatus 16 can be literally any type of known textile dyeing apparatus. Dye is defined as being literally any type of colorant that can be utilized on textile fabrics. The mechanism displayed in FIG. 1 is a single head, textile rotary screen printer, such as one that is manufactured by Johannes Zimmer Vermogensver-Waltungsgmbh located at Ebentaler Strase 133, Klagenfurt 9020, Austria. This dyeing apparatus 16 includes a mesh print screen 20 and a squeegee 21. The mesh print screen 20 is opposite a support roll 26 with the textile fabric 12 passing therebetween. The chemicals from the mesh print screen 20 are applied to the textile fabric in a selectively patterned arrangement. The chemicals include a liquid repellent which can be of literally any type including fluorocarbons, silicones, waxes, and so forth. The chemicals may include a colorant such as a dye, sculpturing agents, texturing agents, dye resists, and so forth.

Samples of rotary print screens can be found in U.S. Pat. No. 5,259,307, issued on Nov. 9, 1993, which is incorporated by reference as if fully set forth herein and U.S. Pat. No. 5,247,882, issued on Sep. 28, 1993 and is incorporated by reference as if fully set forth herein, and U.S. Pat. No. 5,127,321, issued on Jul. 7, 1992, which is also incorporated by reference as if fully set forth herein.

Another means for applying streams of dye to textile fabrics by selective deflection of dye streams with pressurized gas can be found in U.S. Pat. No. 5,161,395, which issued on Nov. 10, 1992, which is incorporated herein by reference. Yet another method of dyeing textiles is disclosed in U.S. Pat. No. 5,330,540, which issued on Jul. 19, 1994, which involves a rotating roll and brush dispersal unit. This disclosure is also incorporated herein by reference. Still another means of dyeing textile fabrics includes a method of producing a plurality of streams of atomized droplets of marking materials to produce a pattern on the substrate, such as that disclosed in U.S. Pat. No. 5,211,339, which issued on May 18, 1993. Once again, the disclosure thereof is incorporated herein by reference. These textile dyeing methods are not meant to be all inclusive and this invention can be utilized with literally any type of known textile dyeing technology. In addition, the textile fabric 12 can be any type of textile fabric with the exception of natural fibers. This is the full spectrum of textile fabrics in which the face finish can be altered by heat that includes those that are merely napped and extends all the way to carpeting. These textile fabrics can be of any construction such as woven, tufted, knitted, nonwoven or flocked.

The textile fabric 12 then passes into a finishing apparatus 34 that typically includes a hot air oven. However, this step can include any of the fixing, steaming, or drying steps that would take place in textile fabric finishing and depends on the type of textile fabric and the desired effect. The textile fabric 12 then moves to take-up roll 14 for collection.

As shown in FIG. 2, the textile fabric 12 from take-up roll 14 is now positioned as supply roll 218. The textile fabric 12 then passes over a first idler roll 232 and into a tank of liquid 234, around a second idler roll 236 and then through a pair of nip rolls 240 and 242 to squeeze out the excess liquid, then around third idler roll 244 to direct the textile fabric 12 to the pressurized heated gas carving head 10. The pair of nip rolls 240 and 242 are placed under pressure by means of an air cylinder (not shown). The liquid is preferably water. However, a multitude of liquids would suffice such as a 95% water and 5% urea combination, alcohol, and so forth.

Figure 5:
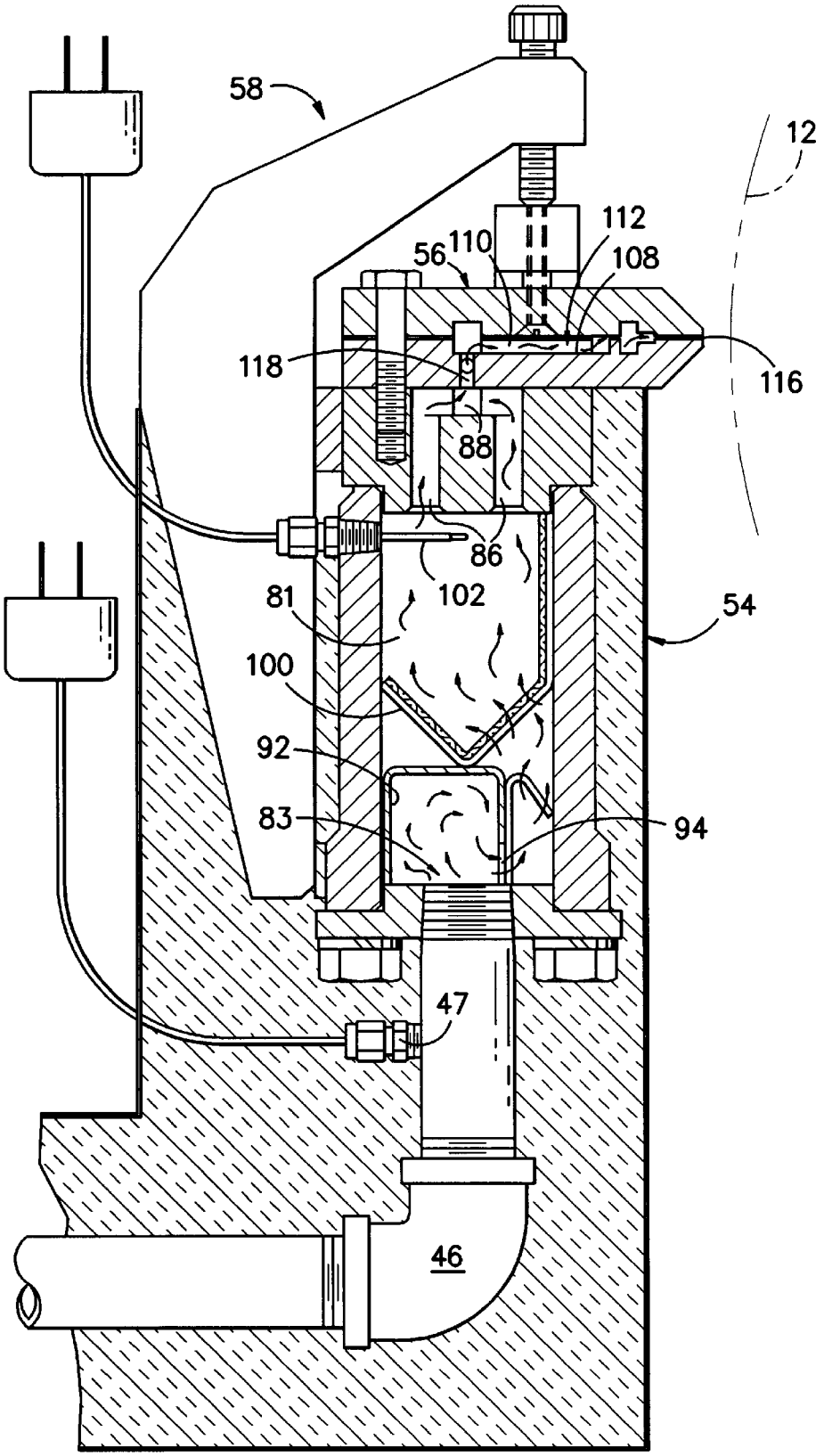
FIG. 5 is a schematic side elevation view of apparatus for heated, pressurized fluid stream treatment of a moving textile fabric to carve a pattern on the surface thereof.
Figure 6:
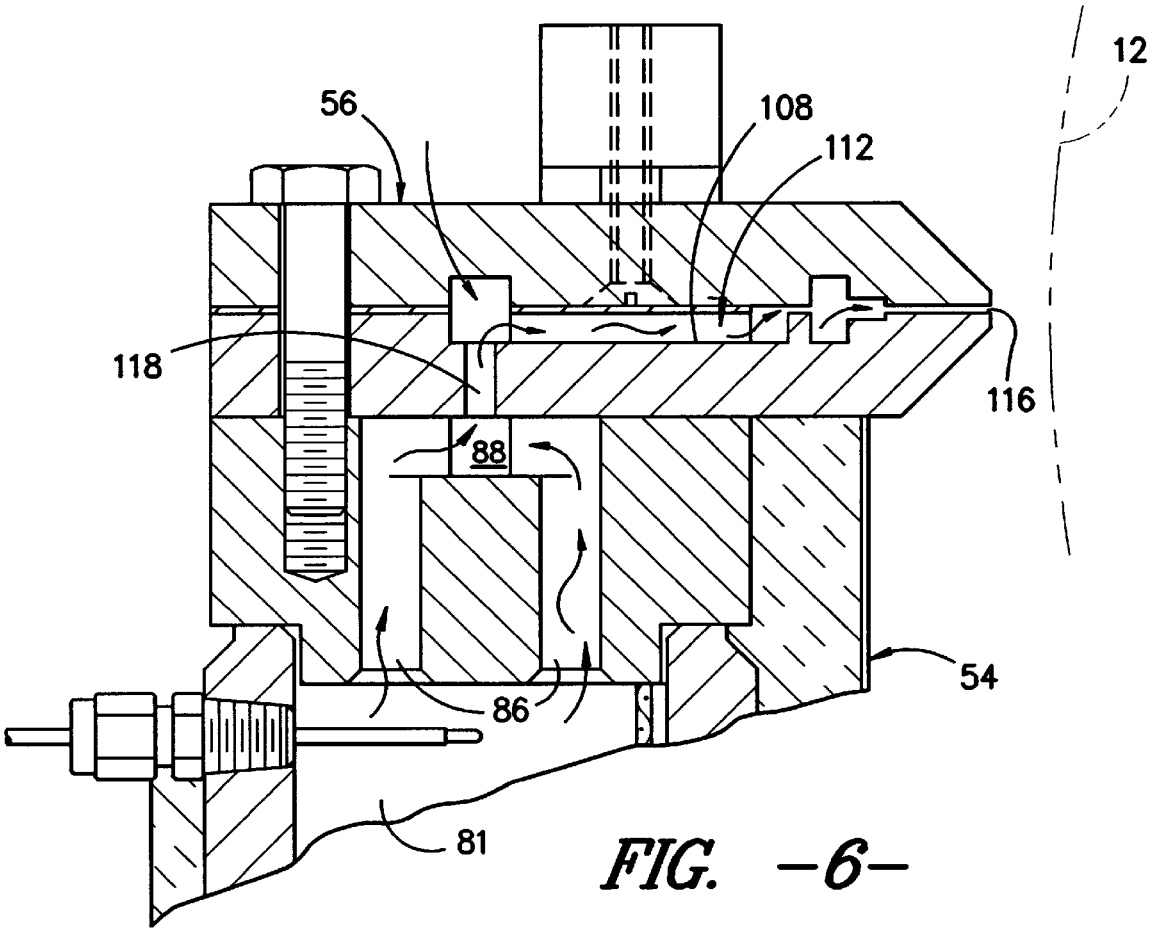
FIG. 6 is an enlarged, broken-away sectional of the fluid stream distributing manifold housing of the manifold assembly as illustrated in FIG. 5.
Figure 8:
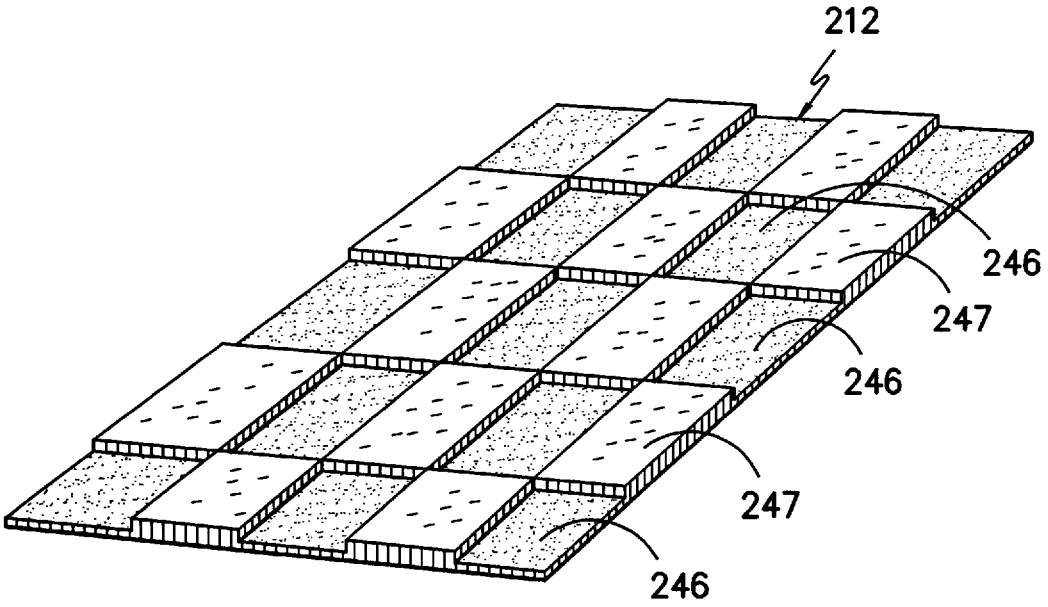
FIG. 8 is a perspective view of a textile fabric that has been selectively carved by means of the present invention.

The textile fabric 12 then passes over a support roll 226 with a pressurized heated gas carving head, generally indicated at 10 on the other side and directly above the textile fabric 12. The surface of the textile fabric 12 passes closely adjacent to the heated gas discharge outlet 116, as shown in FIGS. 5 and 6, of elongate gas distributing manifold assembly 30 of pressurized heated gas carving head 10. Only the portions of the textile fabric 12 that were printed with liquid repellent and remain dry will be carved, thereby affecting the surface of the textile fabric 12 in the treated areas such as lowering the height of the pile if the textile fabric 12 is a pile textile fabric. These carved areas are designated by numeral 246, with the normalized areas designated as 247. The carved textile fabric 12 then passes over a fourth idler roll 249 and into a hot air dryer 280 at a temperature in the range of 230 to 425 degrees Fahrenheit to provide evaporation of remaining liquids. The carved textile fabric 12 then passes onto take-up roll 214 as a finished carved product. As shown in FIG. 8, the carved textile fabric 12 is demonstrated with both the carved areas 246 and normalized areas 247. Carving can result in any one of the following characteristics selected from the group including melted fibers, shrunk fibers, displaced fibers, altered sheen, altered fiber tip definition, altered shade, altered color, altered pile direction, and swollen fibers. These characteristics can vary in magnitude according to process conditions used to obtain a multitude of aesthetic effects.

Figure 3:
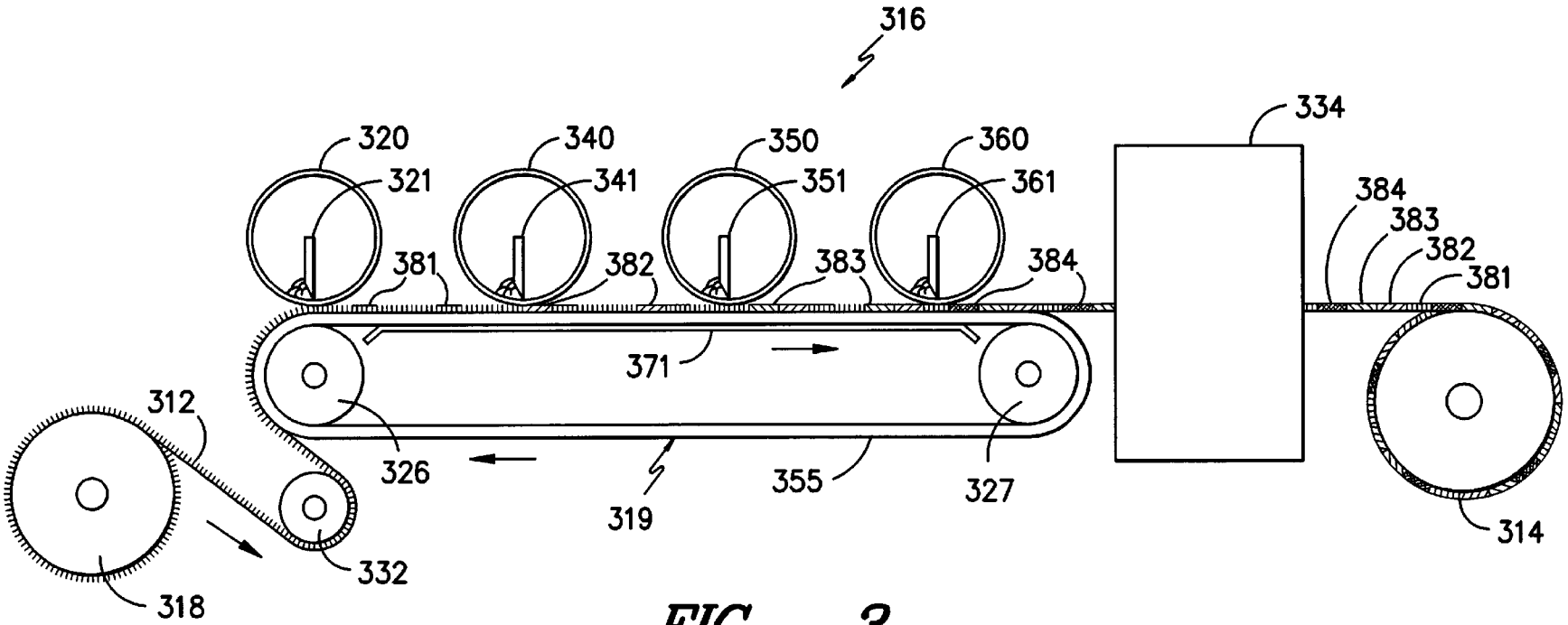
FIG. 3 is another schematic side elevation view of a multiple position rotary screen printer in which chemicals containing liquid repellent with a colorant such as dye are selectively applied by two of the four rotary print heads.

Referring now to FIG. 3, which is analogous to FIG. 1, with the exception of four rotary screen print heads instead of just one rotary screen print head. An indefinite length of textile fabric 312, from a supply roll 318 passes over an idler roll 332, and into a dyeing apparatus 316. The dyeing apparatus 316, in this case, is a four position rotary screen printer. An illustrative example, but not limited to is a rotary screen printer such as one that is manufactured by Johannes Zimmer Vermogensver-Waltungsgmbh located at Ebentaler Strase 133, Klagenfurt 9020, Austria. This dyeing apparatus 316 includes a first mesh print screen 320 and a first squeegee 321, a second mesh print screen 340 and a second squeegee 341, a third mesh print screen 350 and a third squeegee 351, and a fourth mesh print screen 360 and a fourth squeegee 361. These four mesh print screens 320, 340, 350, and 360 are positioned over a belt conveyor 319 having a endless belt 355 that rotates between a first roll 326 and a second roll 327. The textile fabric 312 passes between the four mesh print screens 320, 340, 350, and 360 and the conveyor belt 319 which is supported by support plate 371. The conveyor belt 319 and support plate 371 serve the same function as the support roll 26 in FIG. 1.

The chemicals from the first mesh print screen 320 are applied to the textile fabric 312 in a selectively patterned arrangement as indicated by portion 381. The chemicals from the second mesh print screen 340 are applied to the textile fabric 312 in a selectively patterned arrangement as indicated by portion 382. The chemicals from the third mesh print screen 350 are applied to the textile fabric 312 in a selectively patterned arrangement as indicated by portion 383. The chemicals from the fourth mesh print screen 360 are applied to the textile fabric 312 in a selectively patterned arrangement as indicated by portion 384. The chemicals from the first mesh print screen 320 and the third mesh print screen 350 contain a liquid repellent. As previously mentioned, this liquid repellent can be of literally any type including fluorocarbons, silicones, waxes, and so forth. The textile fabric 312 then passes into a finishing apparatus 334 that typically includes a hot air oven. However, this step can include any of the fixing, steaming, or drying steps that would take place in textile fabric finishing and depends of the type of textile fabric 312 and the desired effect. The textile fabric 312 then moves to take-up roll 314 for collection.

Figure 4:
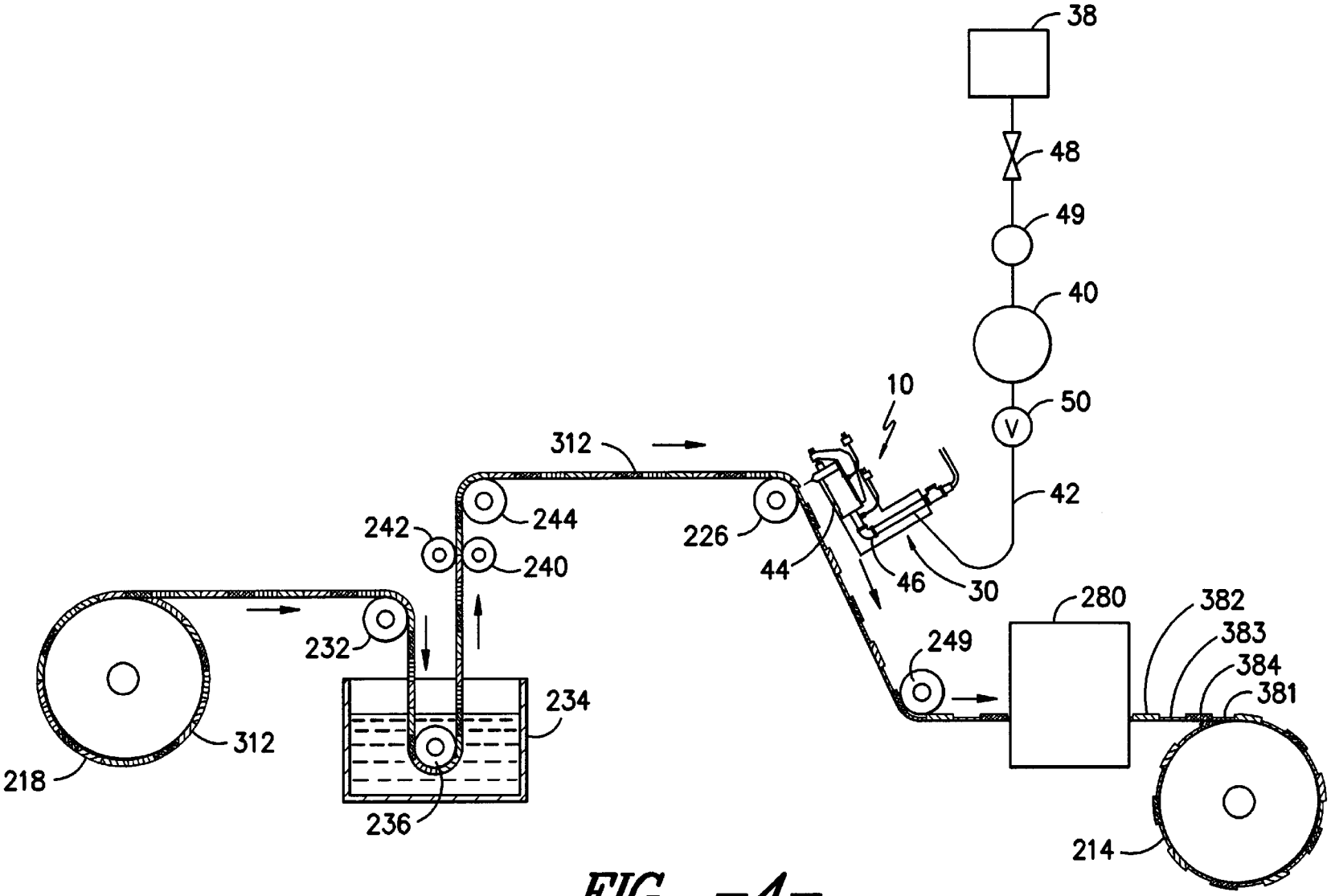
FIG. 4 is a schematic side elevation view of an apparatus for rewetting the textile fabric and carving the textile fabric that has been treated with a liquid repellent, as was previously disclosed in FIG. 3.

Referring now to FIG. 4, which is virtually identical to FIG. 2, the textile fabric 312 from take-up roll 314 is now positioned on supply roll 218. The textile fabric 312 then passes over a first idler roll 232 and into a tank of liquid 234, around a second idler roll 236 and then through a pair of nip rolls 240 and 242 to squeeze out the excess liquid, then around third idler roll 244, which is utilized merely to alter the angle of direction of the textile fabric 312. The pair of nip rolls 240 and 242 are placed under pressure by means of a air cylinder (not shown). The liquid is preferably water. However, a multitude of liquids would suffice such as a 95% water and 5% urea combination, alcohol, and so forth.

The textile fabric 312 then passes over a support roll 226 with a pressurized heated gas carving head, generally indicated at 10 directly opposite and above the textile fabric 312. The surface of the textile fabric 312 passes closely adjacent to the heated fluid discharge outlet 116 as shown in FIGS. 5 and 6, of elongate fluid distributing manifold assembly 30 of the pressurized heated gas carving head 10. Only the portions of the textile fabric 312 that were printed with liquid repellent and remain dry will be carved, thereby affecting the surface of the textile fabric 312 in the treated areas such as lowering the height of the pile if the textile fabric 312 is a pile textile fabric. These carved areas are designated by numerals 381 and 383, with the untreated areas designated as 382 and 384, respectively. The carved textile fabric 312 then passes over a fourth idler roll 249 and into a hot air dryer 280 at a temperature in the range of 230 to 425 degrees Fahrenheit to provide evaporation of remaining liquids. The carved textile fabric 312 then passes onto take-up roll 214 as a finished carved product. Carving can result in any one of the following characteristics selected from the group including melted fibers, shrunk fibers, displaced fibers, altered sheen, altered fiber tip definition, altered shade, altered color, altered pile direction, and swollen fibers. These characteristics can vary in magnitude according to process conditions used to obtain a multitude of aesthetic effects.

As illustrated in FIGS. 2 and 4, the pressurized heated gas carving head 10 includes a source of compressed gas, such as an gas compressor 38, which supplies pressurized gas to an elongate gas header pipe 40. The type of gas is preferably air. Header pipe 40 communicates by a series of gas lines 42, spaced uniformly along its length with a bank of individual electrical heaters indicated generally at 44. The heaters 44 are arranged in parallel along the length of heated fluid distributing manifold assembly 30 and supply heated pressurized gas thereto through short, individual gas supply lines, indicated as 46, which communicate with assembly 30 uniformly along its full length. Gas supply to the heated fluid distributing manifold assembly 30 is controlled by a master control valve 48, pressure regulator valve 49, and individual precision control valves, such as needle valves 50, located in each heater gas supply line 42. The heaters 44 are controlled in a suitable manner, as by temperature sensing means located in the outlet lines 46 of each heater, with regulation of gas flow and electrical power to each of the heaters to maintain the heated fluid at a uniform temperature and pressure as it passes into the manifold assembly 30 along its full length.

Typically, for carving textile fabrics containing thermoplastic yarns, the heaters are employed to heat gas entering the manifold assembly to a predetermined manifold temperature somewhere in the range of 400°–1000° Fahrenheit. However, said range of manifold temperatures may be between the lowest temperature that will affect the fiber properties and the maximum temperature the heater system can produce. The preferred manifold temperature for any given textile fabric 12 depends upon: the components of the textile fabric, the construction of the textile fabric; the desired effect, the speed of transport of the textile fabric, the pressure of the heated pressurized gas; the tension of the textile fabric, the proximity of the textile fabric to the pressurized heated gas carving head 10, the moisture content of the fabric, and others.

The heated fluid distributing manifold assembly 30 is disposed across the full width of the path of movement of the textile fabric 12 and closely adjacent the surface thereof to be treated. Although the length of the manifold assembly may vary, typically in the treatment of textile fabric materials, the length of the manifold assembly may be seventy-six inches or more to accommodate textile fabrics of up to about seventy-two inches in width. However, the length of the manifold assembly can be tailored to conform to virtually any fabric width.

Details of the heated fluid distributing manifold assembly 30 may be best described by reference to FIGS. 5–6. As seen in FIG. 5, which is a partial sectional elevation view through the assembly, there is a first large elongate manifold housing 54 and a second smaller elongate manifold housing 56 secured in fluid tight relationship therewith by a plurality of spaced clamping means, one of which is generally indicated at 58. The manifold housings 54, 56 extend across the full width of the textile fabric 12 adjacent its path of movement.

As best seen in FIG. 5, first elongate manifold housing 54 is of generally rectangular cross-sectional shape, and includes a first elongate gas receiving compartment 81, the ends of which are sealed by end wall plates suitable bolted thereto. Communicating with bottom wall plate through fluid inlet openings, one of which, 83, is shown in FIG. 5, and spaced approximately uniformly therealong are the gas supply lines 46 from each of the electrical heaters 44, as shown in FIGS. 2 and 4. The heaters 44 are controlled in suitable manner, as by temperature sensing means 47 located in the outlet lines 46 of each heater as shown in FIG. 5. A single temperature sensing means 47 can be used as a representative sample for the entire bank of individual heaters. Although economical, the use of one temperature sensing means results in less accuracy. The regulation of air flow and electrical power to each of the heaters maintains the heated fluid at a uniform temperature and pressure as it passes into the manifold assembly along its full length. The temperature of the first elongate fluid receiving compartment 81 is monitored by thermocouple 102 whose input controls the bank of heaters in order to maintain uniform carving of textile fabric 12 across the entire width thereof.

The manifold housings 54, 56 are constructed and arranged so that the flow path of gas through the first housing 54 is generally at a right angle to the discharge axes of the gas stream outlets of the second manifold housing 56.

As best seen in FIGS. 5 and 6, manifold housing 54 is provided with a plurality of gas outlet passageways 86 which are disposed in uniformly spaced relation along the plate in two rows to connect the first gas receiving compartment 81 with a central elongate channel 88.

Baffle plate 92 serves to define a gas receiving chamber in the compartment 81 having side openings or slots 94 to direct the incoming heated gas from the bank of heaters in a generally reversing path of flow through compartment 81. Disposed above channel-shaped baffle plate 92 is compartment 81 between the gas inlet openings 83 and gas outlet passageways 86 is an elongate filter member 100 which is a generally J-shaped plate with a filter screen disposed thereabout.

Figure 7:
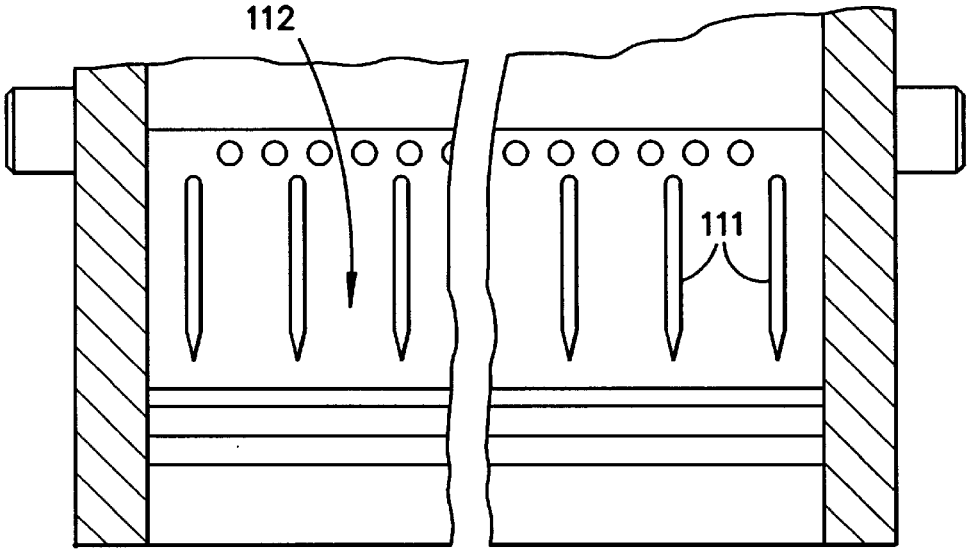
FIG. 7 is an enlarged broken-away sectional view of an end portion of the fluid stream distributing manifold housing.

As seen in FIGS. 5, 6 and 7, a second smaller manifold housing 56 comprises first and second opposed elongate wall members, each of which has an elongate recess or channel 108 therein. Wall members are disposed in spaced, coextensive parallel relation with their recesses 108 in facing relation to form upper and lower wall portions of a second gas receiving compartment 110, in the second manifold housing 56. The gas then passes through a third gas receiving compartment 112 in the lower wall member of manifold housing 56 which is defined by small elongate islands 111 approximately uniformly spaced along the length of the member, as shown in FIG. 7. A continuous slit 116 directs heated pressurized gas from the third gas receiving compartment 112 in a continuous sheet across the width of the fabric onto the surface of the moving textile fabric 12. Typically, in the treatment of textile fabrics such as pile fabrics containing thermoplastic pile yarn, the continuous slit 116 of manifold 56 may be 0.015 to about 0.030 of an inch in thickness. For precise control of the heated gas streams carving the fabric, the continuous slit 116 is preferably maintained as close to fabric surface as possible, typically less than 0.025–0.050 inches. However, this distance from the face of the textile fabric 12 can be as much as 0.100 of an inch and still produce good pattern definition.

Second manifold housing 56 is provided with a plurality of spaced gas inlet openings 118 (FIGS. 5 and 6) which communicate with the elongate channel 88 of the first manifold housing 54 along its length to receive pressurized heated gas from the first manifold housing 54 into the second gas receiving compartment 110.

Another embodiment would be to treat the yarn or fibers with a chemical containing a liquid repellant either alone or with a colorant such as dye prior to weaving, knitting, needling or tufting the fibers into a textile fabric. This textile fabric is then processed in the same manner as shown in FIGS. 2 and 4. The textile fabric 12, 312 is now positioned as supply roll 218. The textile fabric 12, 312 then passes over a first idler roll 232 and into a tank of liquid 234, around a second idler roll 236 and then through a pair of nip rolls 240 and 242 to squeeze out the excess liquid, then around third idler roll 244 to direct the textile fabric 12, 312 to the pressurized heated gas carving head 10. The pair of nip rolls 240 and 242 are placed under pressure by means of an air cylinder (not shown). The liquid is preferably water. However, a multitude of liquids would suffice such as 95% water and 5% urea combination, alcohol, and so forth.

Figure 9:
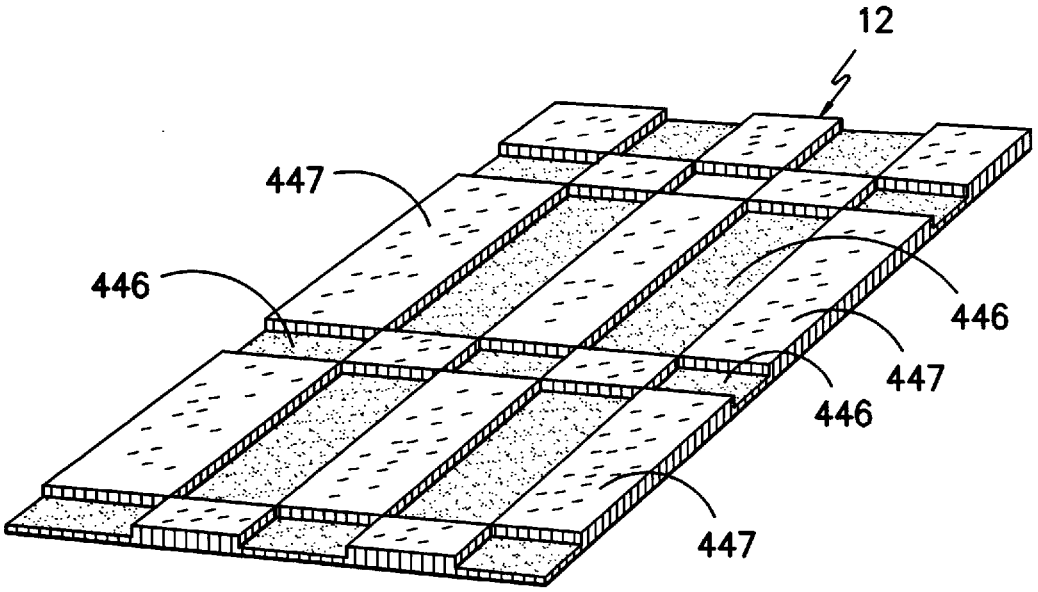
FIG. 9 is a perspective view of a textile fabric that has yarns that have been pretreated with a liquid repellant, whereby the pretreated yarns have been selectively carved by means of the present invention.

The textile fabric 12, 312 then passes over a support roll 226 with a pressurized heated gas carving head, generally indicated at 10 on the other side and directly above the textile fabric 12, 312. The surface of the textile fabric 12, 312 passes closely adjacent to the heated gas discharge outlet 116, as shown in FIG. 6, of elongate gas distributing manifold assembly 30 of pressurized heated gas carving head 10. Only the portions of the textile fabric 12, 312 that were treated with liquid repellent and remain dry will be carved, thereby affecting the surface of the textile fabric 12, 312 in the treated areas such as lowering the height of the pile if the textile fabric 12, 312 is a pile textile fabric. The carved textile fabric 12, 312 then passes over a fourth idler roll 249 and into a hot air dryer 280 at a temperature in the range of 230 to 425 degrees Fahrenheit to provide evaporation of remaining liquids. The carved textile fabric 12, 312 then passes onto take-up roll 214 as a finished carved product. As shown in FIG. 9, the carved textile fabric 12 is demonstrated with both the carved areas 446 and normalized yarns 447. Carving can result in any one of the following characteristics selected from the group including melted fibers, shrunk fibers, displaced fibers, altered sheen, altered fiber tip definition, altered shade, altered color, altered pile direction, and swollen fibers. These characteristics can vary in magnitude according to process conditions used to obtain a multitude of aesthetic effects.

EXAMPLE

As best illustrated by FIGS. 3 and 4, a Zimmer rotary screen printer is utilized with a 125 mesh print screen, a speed of five yards per minute, a squeegee size of two inches in diameter and a magnet setting of six. The Zimmer printer is manufactured by Johannes Zimmer Vermogensver-Waltungsgmbh located at Ebentaler Strase 133, Klagenfurt 9020, Austria. The print paste utilized by first mesh print screen 320 and third mesh print screen 350 is a mixture of one to three percent disperse dye mix such as Transit Blue BLF manufactured by Ciba-Geigy Corporation located at 3400 Westinghouse Blvd., P.O. Box 7648, Charlotte, N.C. 28241. The liquid repellant makes up approximately five percent of the total solution. The liquid repellant is FC 251 manufactured by Minnesota Mining & Manufacturing Company (3M) located at 3M Center, St. Paul Minn. 55144-1000. There is a gum for thickening that constitutes approximately one percent of the total solution and has a viscosity of 700 to 2000 cps. The remainder of the solution is water.

The heat set aspect of the textile fabric finishing that occurs in the finishing apparatus 334 is a hot air oven that is at a temperature of 350 degrees Fahrenheit that treats the textile fabric 312 for one minute.

The rewetter is a tank of water providing a liquid bath 234. The nip rolls 240, 242 form a rewet pad and utilize an air cylinder with 50 p.s.i. of air pressure applied thereto for placing pressure on the textile fabric 312.

The pressurized heated gas carving head 10 is a hot air nozzle with a continuous slit 116 with a 0.017 inch opening. The temperature is 750 degrees Fahrenheit with an air pressure of 1.5 pounds per square inch. The speed of the textile fabric 312 past the support roll 226 is eight yards per minute. There is a distance of 0.90 inches between the heated fluid discharge outlet 116 and the support roll 226, as shown in FIG. 6.

As the invention may be embodied in several forms without departing from the spirit or essential character thereof, the embodiments presented herein are intended to be illustrative and not descriptive. The scope of the invention is intended to be defined by the following appended Claims, rather than any descriptive matter hereinabove, and all embodiments of the invention which fall within the meaning and range of equivalency of such Claims are, therefore, intended to be embraced by such Claims.

What is claimed is:

1. A process for carving areas of a textile fabric comprising the steps of:

(a) applying a chemical solution comprising a liquid repellent to a surface of said textile fabric;

(b) applying liquid to said textile fabric; and (c) directing pressurized heated gas at said surface of said textile fabric to carve said surface of said textile fabric where said liquid repellant was applied.

2. The process according to claim 1, wherein the step of directing pressurized heated gas at said surface of said textile fabric creates one or more physical changes in said textile fabric selected from the group consisting of melted fibers, shrunken fibers, displaced fibers, and swollen fibers.

3. The process according to claim 1, wherein said chemical solution applied in step (a) comprises a liquid repellent and a dye.

4. The process according to claim 3, wherein said heated gas is directed at said surface of said textile fabric at a pressure of about 1 to 3 p.s.i.g.

5. The process according to claim 1, wherein said textile fabric is a carpet pile.

6. A process for carving areas of a web of textile fabric comprising the steps of:

(a) applying a first chemical solution comprising a liquid repellent to a surface of said web of textile fabric;

(b) applying a second chemical solution comprising a dye to said surface of said web of textile fabric;

(c) applying liquid to said web of textile fabric; and (d) directing pressurized heated gas at said surface of said web of textile fabric to carve said surface of said textile fabric where said liquid repellant was applied.

7. The process according to claim 6, wherein said first chemical solution comprises a liquid repellent and at least one additional agent selected from the group consisting of dye, sculpting agent, texturing agent and dye resist.

8. The process according to claim 6, wherein said second chemical solution comprises one or more constituents selected from the group consisting of dye, dye resist, sculpting agent and texturizing agent.

9. The process according to claim 6, wherein said textile fabric is a carpet pile.

10. A process for carving areas of a textile fabric formed of yarns that are pretreated with a chemical solution comprising a liquid repellent, the process comprising the steps of:

(a) applying liquid to areas of said textile fabric; and (b) directing pressurized heated gas at said surface of said textile fabric to carve said surface of said textile fabric where liquid repellant is present on said yarns.

11. A process for carving textile fabric comprising the steps of:

(a) applying a chemical solution comprising a liquid repellent to a first set of yarns;

(b) forming a fabric by weaving, knitting, or needling said first set of yarns with other yarns to form a textile fabric;

(c) applying liquid to said textile fabric; and (d) directing pressurized heated gas at said surface of said textile fabric to carve said first set of yarns of said textile fabric where said liquid repellant was applied.

* * * * *